US005913499A

United States Patent [19]

Kiggins

[11] Patent Number: 5,913,499

[45] Date of Patent: Jun. 22, 1999

[54] MERCHANDISE DISPLAY SUPPORT

[75] Inventor: Timothy Reed Kiggins, Syracuse, N.Y.

[73] Assignee: Pass & Seymour, Inc., Syracuse, N.Y.

[21] Appl. No.: 08/889,784

[22] Filed: Jul. 8, 1997

Related U.S. Application Data

[63] Continuation-in-part of application No. 08/513,458, Aug. 10, 1995.

[51] Int. Cl.[6] ..... F16M 11/00

[52] U.S. Cl. ..... 248/200; 248/220.31

[58] Field of Search ..... 248/200, 205.1, 248/205.3, 291.1, 300, 906, 220.31; 211/87.01

[56] References Cited

U.S. PATENT DOCUMENTS

| | | | |
|---|---|---|---|
| D. 248,730 | 8/1978 | Blann . | |
| D. 260,674 | 9/1981 | Simmons et al. . | |
| D. 329,349 | 9/1992 | Moreno . | |
| D. 352,413 | 11/1994 | Ballard . | |
| 1,939,027 | 12/1933 | Stewart . | |
| 3,409,260 | 11/1968 | Bleed | 248/220.31 |
| 4,366,908 | 1/1983 | Anderson . | |
| 4,783,033 | 11/1988 | Valiulis | 248/220.31 |
| 4,801,116 | 1/1989 | Blankenship | 248/220.31 |
| 5,316,254 | 5/1994 | McCartha . | |
| 5,386,959 | 2/1995 | Laughlin et al. . | |
| 5,423,436 | 6/1995 | Morrow | 248/220.31 |
| 5,516,068 | 5/1996 | Rice . | |

*Primary Examiner*—Leslie A. Braun
*Assistant Examiner*—Willie Berry, Jr.
*Attorney, Agent, or Firm*—Bond, Sehoeneck & King, LLP; Stephen B. Salai

[57] ABSTRACT

An item of merchandise is mounted for visual and tactile inspection by shoppers in a retail setting upon a support member which is attached to a fixed support conventionally present in the store. Three types of support members, for alternative use, are disclosed. A first of the support members includes openings for passage of screws into a vertically disposed surface such as a pegboard. A second support member includes a U-shaped bracket having outwardly directed flanges for engagement with the spaced channels of a conventional, horizontally disposed track member on the front of a store shelf, or the like. A third type of support member includes a mounting device having a pair of hooks and a stabilizing bar, removably attachable to the mounting device and also having a pair of hooks, for mounting a peg bar into holes of a pegboard. A bracket affixed to the merchandise item may be attached to any of the support members, and the angular orientation of the item may be selectively varied in accordance with its height above floor level.

27 Claims, 7 Drawing Sheets

MERCHANDISE DISPLAY SUPPORT

This application is a Continuation-In-Part of U.S. patent application Ser. No. 08/513,458 filed on Aug. 10, 1995 naming Timothy R. Kiggins as inventor, pending.

FIELD OF THE INVENTION

The present invention relates to supports for the display of items of merchandise in a retail setting. More particularly, the invention relates to hardware for supporting an item of merchandise to permit visual and tactile examination by customers in a location where such items are normally stocked in packaged form.

BACKGROUND OF THE INVENTION

Many types of relatively small (e.g., hand-held) items are stocked on store shelves in boxes or cartons from which the item must be removed for visual and tactile examination by the shopper. Some types of packaging are designed to permit viewing of portions of the item, e.g., by blister or shrink packaging wherein the item is covered by transparent plastic affixed to an opaque card. However, the items are normally not viewable from all sides and may not be physically handled outside the package, as is often desirable, e.g., with items having parts intended for manual manipulation under conditions of actual use.

It is a principal object of the present invention to provide a simple and economical, yet highly effective and versatile means of displaying merchandise items in a retail environment.

A further object is to provide a physical support for an item of merchandise to permit both complete visual inspection and manual manipulation of moveable parts by a prospective purchaser.

Another object is to provide merchandise display apparatus which permits selective mounting upon either a vertical surface having preformed holes therein, or upon a conventional track or channel member on the front edge of a store shelf.

Still another object is to provide support means for an item of merchandise which permit display of the item in any one of a plurality of rotational orientations, depending upon its height above floor level.

Other objects will in part be obvious and in part appear hereinafter.

SUMMARY OF THE INVENTION

Although the invention may be employed in conjunction with a wide variety of merchandise items, it is disclosed as a support for a dimmer switch including a box-like housing for mounting in a wall. An L-shaped bracket may be affixed to the back of the housing with one side of the bracket extending rearwardly from the housing and having a plurality of openings therein.

In one embodiment, a first support member is formed from a flat metal rod having a major length portion, e.g. about 12", and a minor length portion, e.g., about 2", extending linearly at 90 degrees to one another. A first pair of spaced openings through the minor length portion are provided for passage of screws to mount the support member upon a vertical surface in a retail sales area. A second pair of spaced openings are provided near the free end of the major length portion for passage of threaded fasteners to affix the bracket on the rear of the merchandise item to the first support member. The plurality of openings in the bracket permit selective positioning of the item in several rotationed orientations depending upon the height above floor level at which the first support member is mounted. A small plate is preferably affixed to the major length portion to provide a surface flush with the minor length portion for added stability of the first support member against the vertical surface upon which it is mounted.

In another embodiment, a second mounting member includes a generally U-shaped bracket with outwardly directed flanges or edge portions along each of the free ends. One side of an L-shaped bracket is affixed to the planar, medial portion of the U-shaped bracket. The other side of the L-shaped bracket extends outwardly from the medial portion of the U-shaped bracket in a plane perpendicular thereto. A pair of openings in the other side of the L-shaped bracket are provided for passage of threaded fasteners to releasably connect the L-shaped bracket on the rear of the merchandise item to that of the second mounting member. The outwardly directed flanges on the U-shaped bracket are dimensioned for resilient engagement with the channels of a conventional track member on the front edge of a store shelf. The plurality of openings in the L-shaped bracket on the merchandise item permits selective mounting thereof in a number of rotational orientations with respect to the second support member, as with the first support member.

In another embodiment of the invention, a third support member may comprise a peg bar having a distal end adapted to be adjacent a peg board and a proximal end for supporting an item, a mounting device attached to the distal end of the peg bar, the mounting device having two hooks adapted to be inserted into holes of a peg board, and, a stabilizing bar adapted to be removably attached to the mounting device, the stabilizing bar having two hooks adapted to be inserted into holes of a peg board. When mounting this third support member to a peg board, the hooks of the mounting device are inserted into the peg board, then a U-shaped member of the mounting device is lifted to allow the stabilizing bar to be hooked onto the pegboard at a location where a screw extending from the stabilizing bar may pass through a slot formed by the U-shaped member. A nut may then be placed over the threaded portion of the screw to secure the stabilizing bar to the mounting device. An L-shaped bracket may be provided as in the previous embodiments. The peg bar may be provided with a pin which can be inserted into one of the openings in the L-shaped bracket to eliminate extra pieces.

The first, second, and third support members may be provided, together with a representative merchandise item with the L-shaped bracket affixed thereto as a kit for use by the retailer. Depending upon store layout and facilities, the merchandise item may be mounted upon any of the support members in an appropriate orientation for both complete visual inspection and, where applicable, manual manipulation by the prospective purchasers.

The foregoing and other features and advantages of the invention will be more readily understood and fully appreciated from the following detailed description, taken in conjunction with the accompanying drawings.

DETAILED DESCRIPTION

Figure 1:
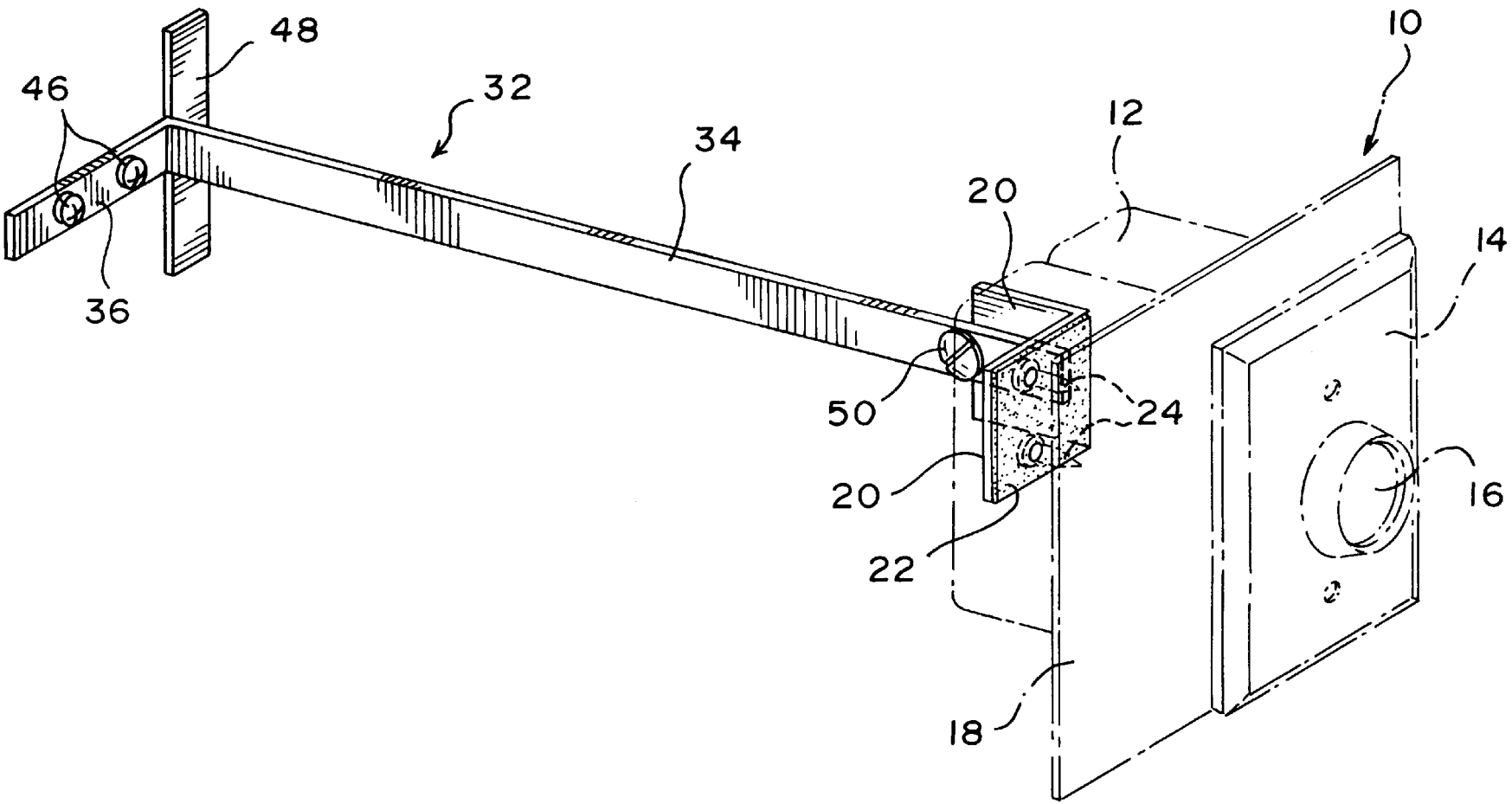
FIG. 1 is a perspective view of a representative merchandise item, shown in phantom lines, supported for display by a first support member in one embodiment of the present invention.
Figure 2:
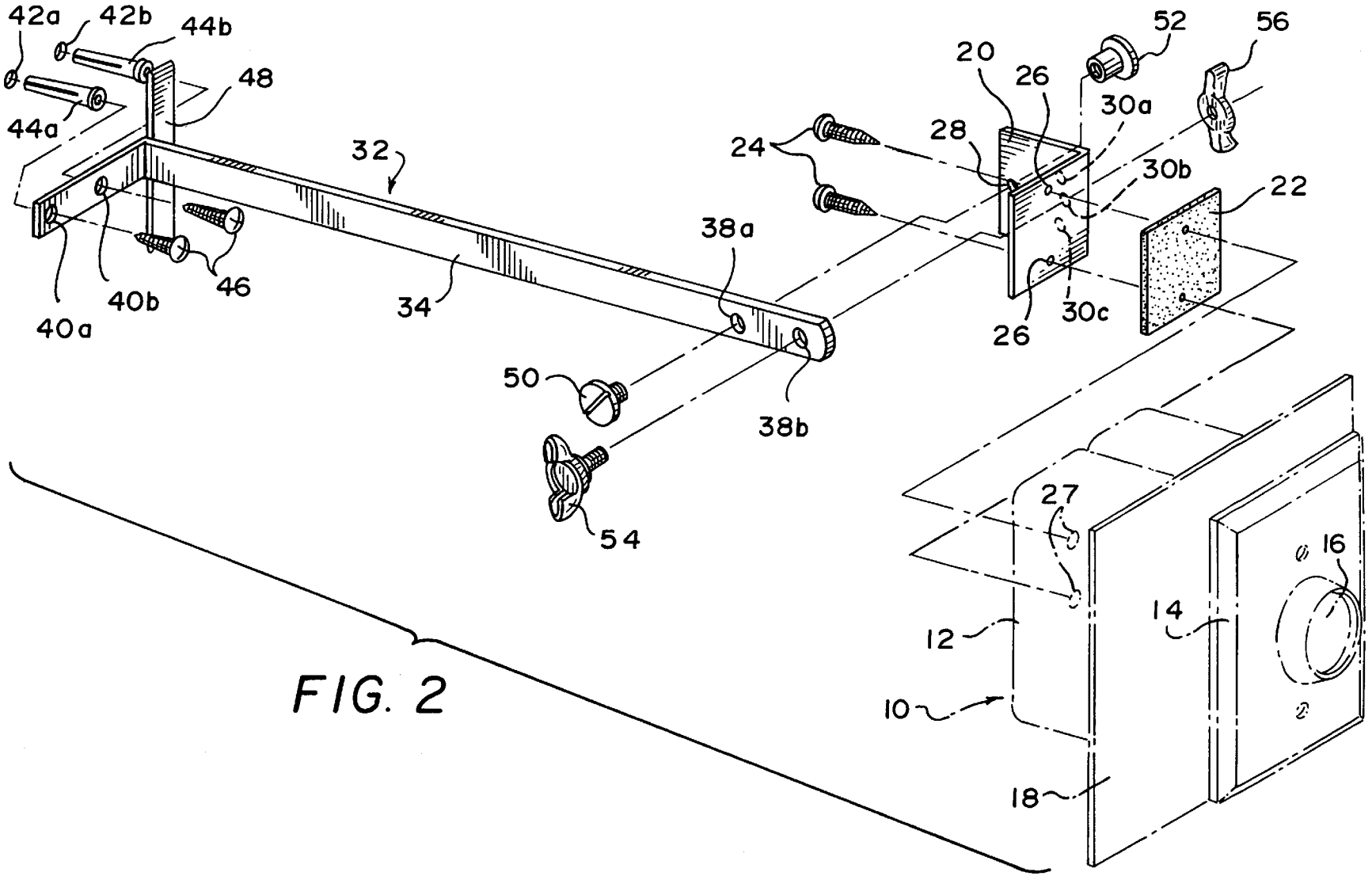
FIG. 2 is an exploded perspective view of the elements of FIG. 1.

Referring now to the drawings, in FIGS. 1 and 2 is shown an item of merchandise for display to customers in a retail setting. The merchandise item selected for illustration is a dimmer-type electric light switch, denoted generally by reference numeral 10 and including a box-like housing 12 for installation in a wall opening, a wall plate 14 to cover the openings in the wall and the front of housing 12, and operating knob 16 which may be both pushed to effect on-off control, and turned to effect brightness control. Card 18, bearing printed information concerning switch 10, is held between housing 12 and wall plate 14. These elements are shown in phantom lines since the support means of the invention may be employed with a wide variety of merchandise items, and the particular type or structure of the item is of no consequence, provided it is a three-dimensional item of relatively small size, i.e., susceptible of being hand-held, and includes a substantially planar surface portion, in this case a portion the rear surface of housing 12.

An L-shaped bracket, having first and second, essentially planar portions 18 and 20, respectively, is securely fastened to the planar rear surface portion of housing 12. In the illustrated embodiment, first portion 18 of the bracket is affixed to housing 12 by either or both of a double-sided adhesive sheet 22 and screws 24, the latter extending through openings 26 in first portion 18 and in sheet 22, if present, and threaded into openings 27 in housing 12. A plurality of through openings in second bracket portion 20 include first opening 28 and a plurality of second openings 30*a,* 30*b* and 30*c*. The center-to-center distance from first opening 28 to each of openings 30*a,* 30*b* and 30*c* is substantially equal.

A first support member, denoted generally by reference numeral 32, includes a flat metal rod having major and minor length portions 34 and 36, respectively, extending along linear, perpendicular axes. A pair of openings 38*a* and 38*b* are spaced from one another along the axis of major length portion 34, near what is termed the proximal end of support member 32. Another pair of openings 40*a* and 40*b* are provided in minor length portion 36 at the distal end.

Support member 32 is designed for mounting upon a vertical surface having a pair of preformed openings 42*a* and 42*b,* horizontally spaced for alignment therewith of openings 40*a* and 40*b,* respectively. Conventional, hollow, expansible anchors 44*a* and 44*b* may be inserted into openings 42*a* and 42*b,* respectively, where appropriate to receive screws 46. Openings 42*a* and 42*b* may be a pair of the plurality of evenly-spaced openings arranged in perpendicular rows and columns in a sheet of so-called pegboard such as is often provided as a vertical support for rods upon which packaged merchandise items are hung.

Flat metal strip 48 is permanently attached, e.g., by welding, along one edge at the juncture of major and minor length portions 34 and 36, to complete support member 32. When support member 32 is mounted in the indicated manner, with the longitudinal axes of both major and minor length portions 34 and 36 horizontally disposed, the longitudinal axis of strip 48 is vertical and its rear surface is coplanar with that of minor length portion 36. Thus, the rear surface of strip 48 bears against the vertical surface upon which support member 32 is mounted to provide added stability.

Switch 10 is removably mounted upon support member 32 by a pair of threaded fasteners, each having two parts. Externally threaded element 50 is received in internally threaded element 52 as the elements extend through aligned openings 28 and 38*a* of bracket portion 20 and support member portion 34, respectively. Screw element 54 extends through opening 38*b* in support member portion 34 and through one of openings 30*a,* 30*b* and 30*c* in bracket portion 20, and is secured by wing nut 56.

Figure 3:
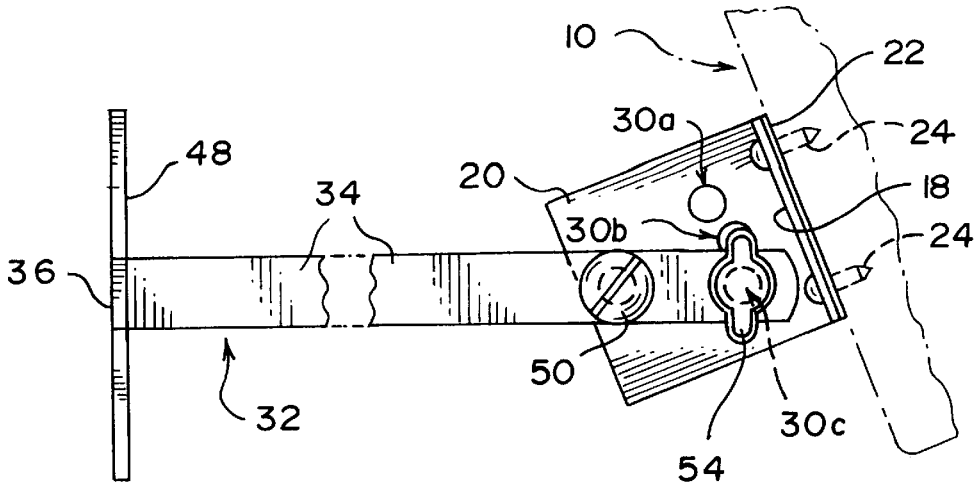
FIGS. 3–5 are fragmentary, side elevational views of the elements of FIGS. 1 and 2, showing the merchandise item in a plurality of selective rotational orientations with respect to the support member.
Figure 4:
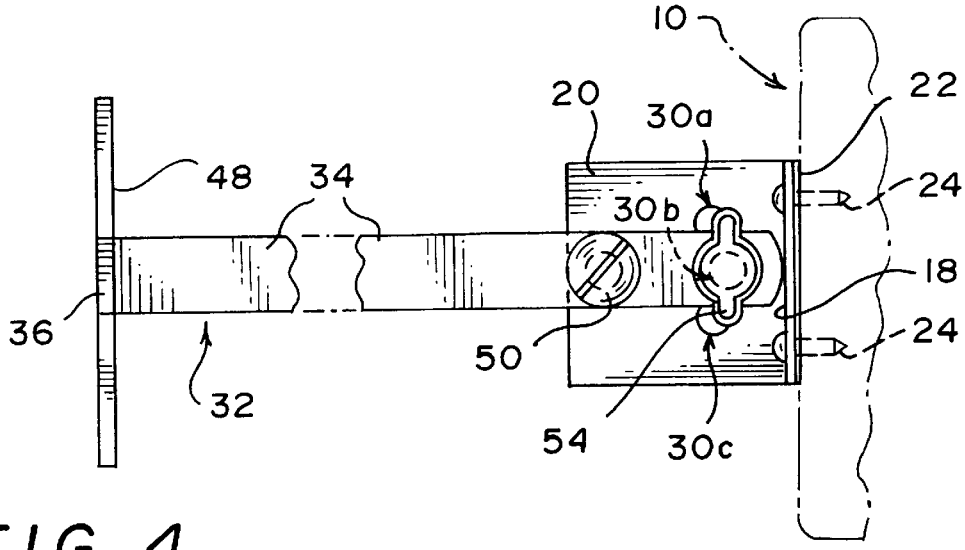
Figure 5:
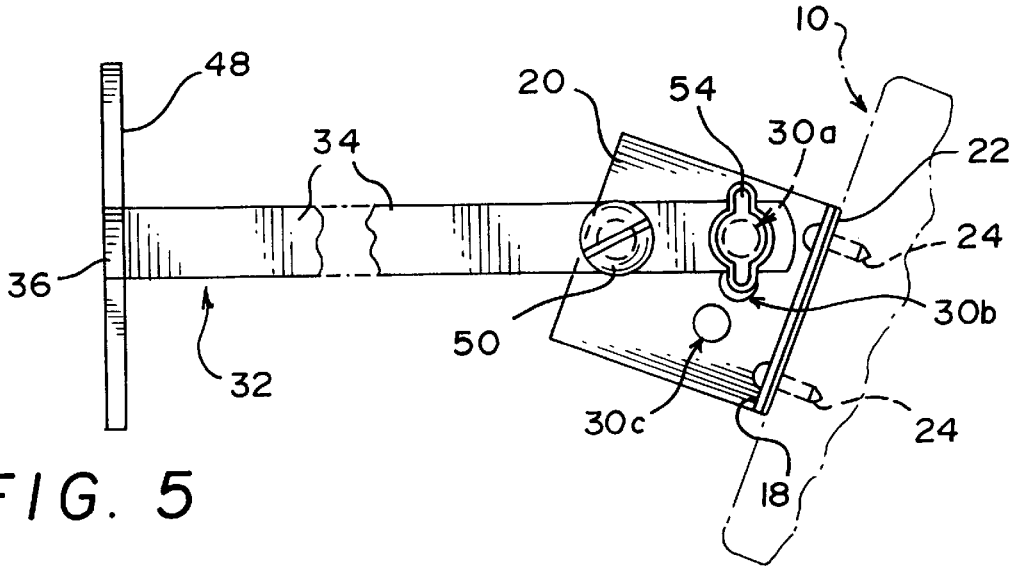

FIGS. 3, 4, and 5 illustrate the three, selective rotational orientations of the merchandise item with respect to the support member. The orientation selected is that which places the item most nearly in the line of sight of a shopper standing in front of the display. For example, if support member 32 is mounted at a position significantly below eye level, opening 30*c* is aligned with opening 38*b* and screw element 54 is inserted through the aligned openings to place switch 10 with its front face tilted upwardly, as shown in FIG. 3. If support member is mounted at or near average eye level, central opening 30*b* is aligned with opening 38*b* as seen in FIG. 4. Also, as seen in FIG. 5, switch 10 may be placed in a downwardly tilted orientation when support member 32 is positioned a significant distance above average eye level.

Figure 6:
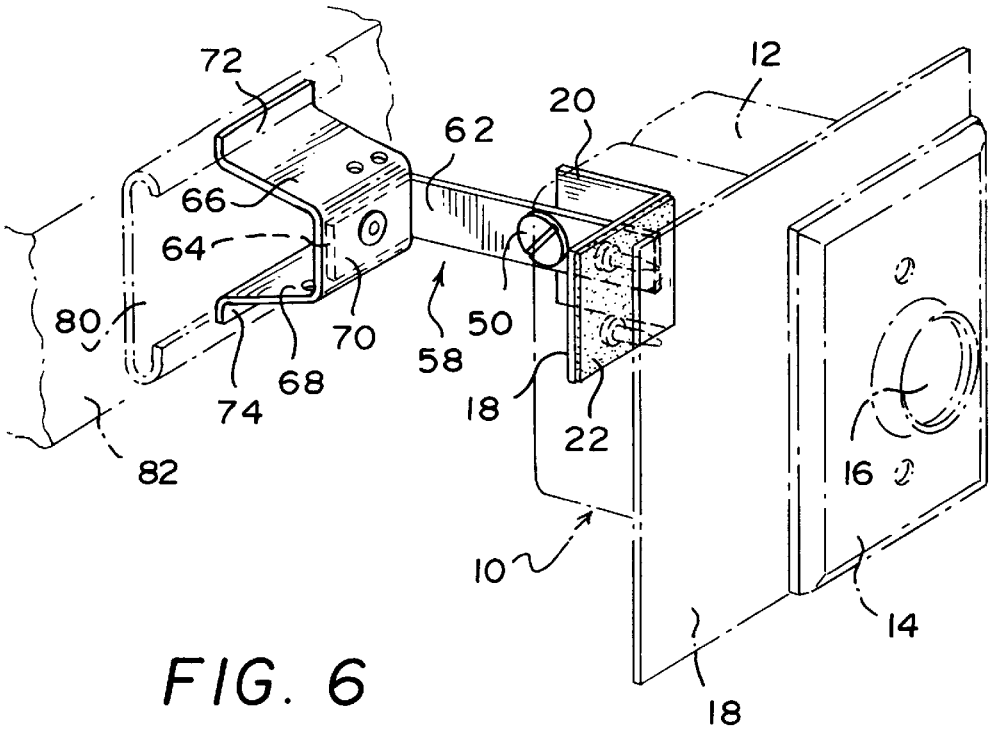
FIG. 6 is a perspective view of the merchandise item supported for display by a second support member in another embodiment of the present invention, useable alternatively to the support member of FIGS. 1–5.
Figure 7:
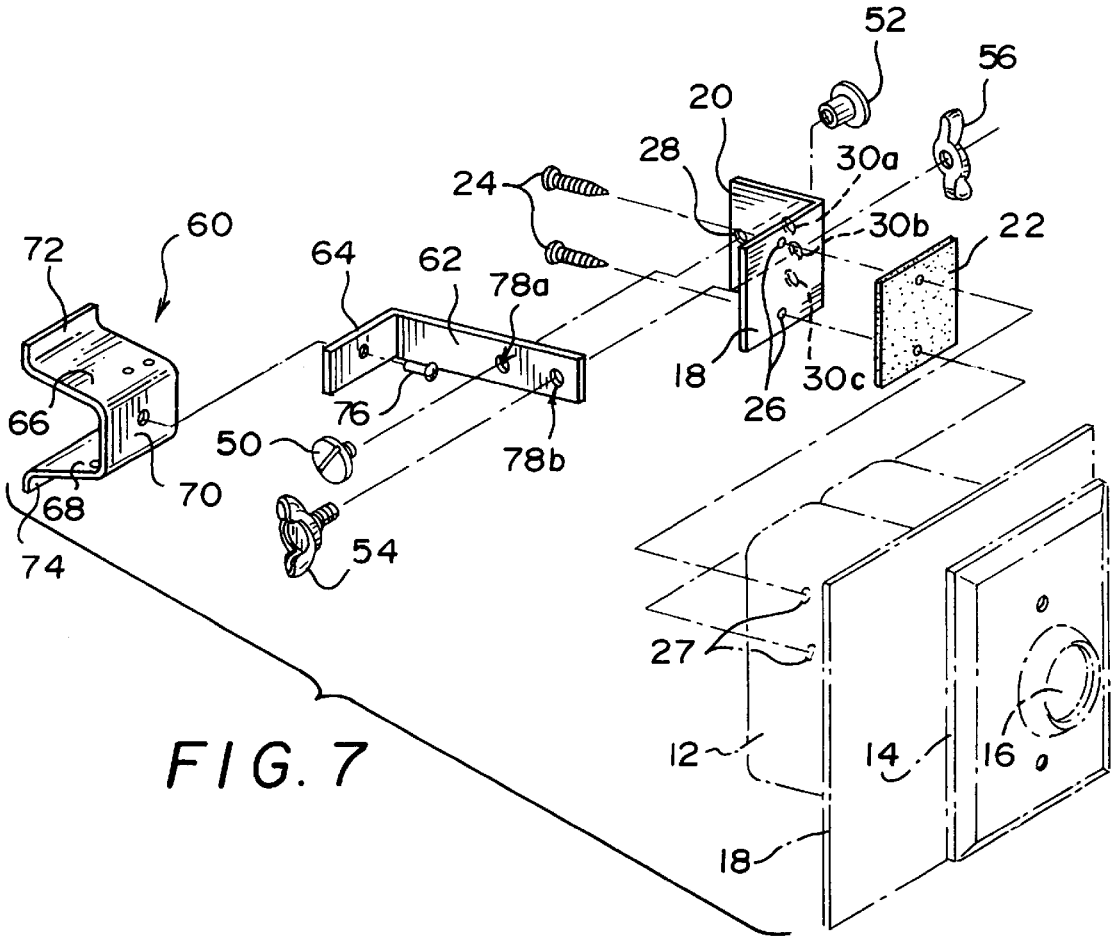
FIG. 7 is an exploded perspective view of the elements of FIG. 6.

Turning now to FIGS. 6 and 7, a second form of support member, indicated by reference numeral 58, is provided for use alternatively to support member 32. The L-shaped bracket having portions 18 and 20 is affixed to the rear, planar surface portion of dimmer switch 10 as previously described. Support member 58 comprises substantially U-shaped bracket 60 and a further L-shaped bracket having essentially planar portions 62 and 64 disposed in perpendicular planes. U-shaped bracket 60 includes a pair of arms 66 and 68, connected by medial portion 70 and having outwardly directed flanges 72 and 74 extending along their respective free ends.

Portion 64 of the L-shaped bracket is fixedly attached to medial portion 70 of U-shaped bracket 60 by any desired means such as illustrated rivet 76. A pair of openings 78*a* and 78*b* are provided in portion 62 of the L-shaped bracket, spaced along its longitudinal axis. Dimmer switch 10 is detachably mounted upon support member 58 in essentially the same manner as its previously described mounting upon support member 32. That is, threaded fastening elements 50 and 52 are mutually secured in aligned openings 28 and 78*a,* and screw element 54 extends through opening 78*b* and one of openings 30*a,* 30*b* and 30*c* aligned therewith.

Support member 58 is designed for mounting upon a conventional track member such as those commonly attached to the front edges of store shelves for holding price tags, or the like, in proximity to merchandise stocked on the shelves. A fragment of such a track member is shown in phantom lines in FIG. 6, denoted by reference numeral 80 and mounted on the front edge of store shelf 82. A limited amount of resilience of U-shaped bracket 60 permits the free ends of arms 66 and 68 thereof to be moved a short distance toward one another, whereby flanges 72 and 74 may be inserted in the horizontally disposed channels on each side of track member 80. Alternately, flanges 72 and 74 may be slid into the spaced channels of track member 80 from one end thereof. Dimmer switch 10 is then displayed in a position forwardly of the store shelf, as illustrated in FIG. 6. Of course, switch 10 may be placed in any of the previously described rotational orientations about the horizontal axis of threaded fasteners 50 and 52 with respect to mounting member 58.

Figure 8:
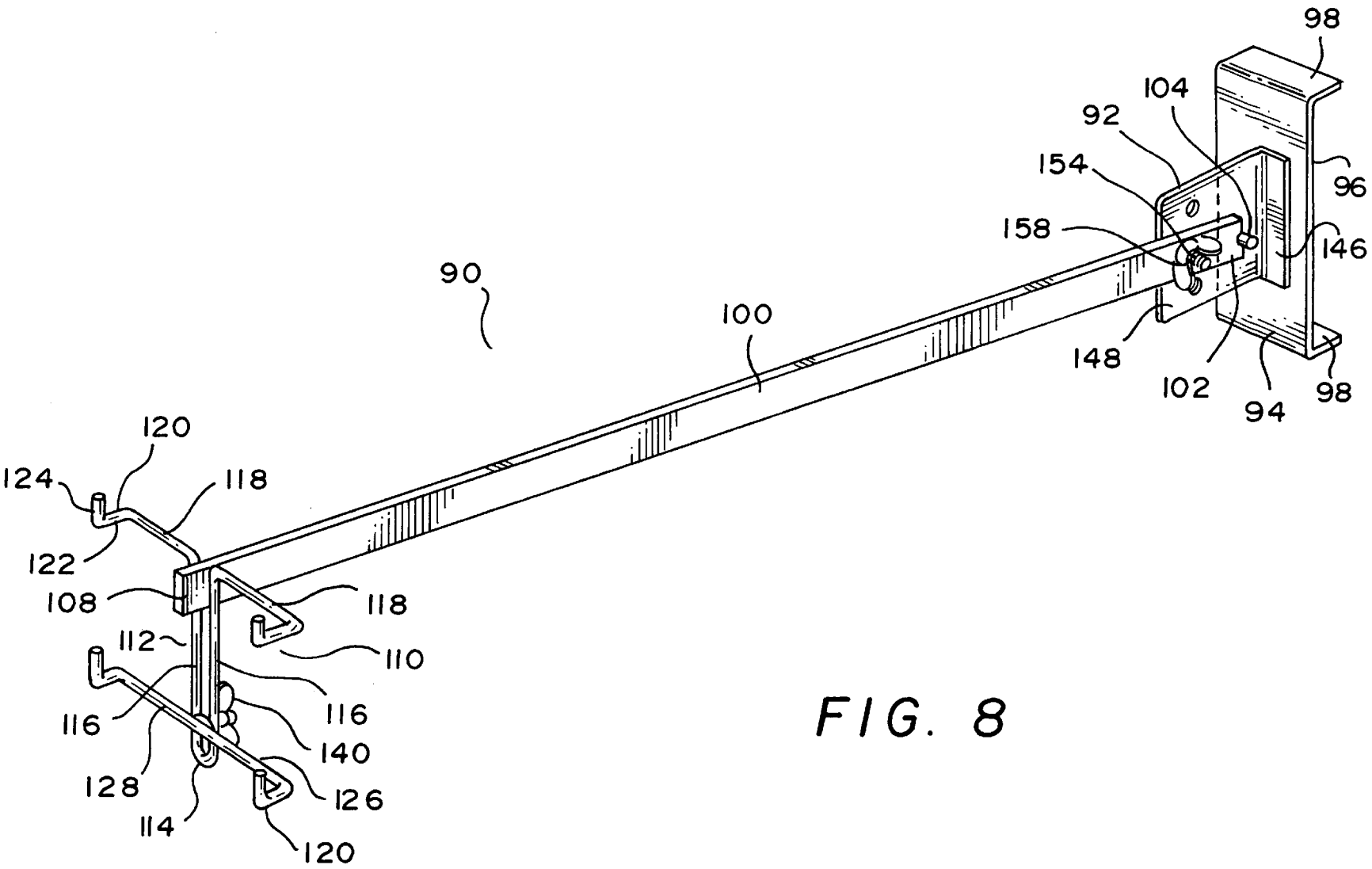
FIG. 8 is a side perspective view of another support member in a preferred embodiment of the invention.
Figure 9:
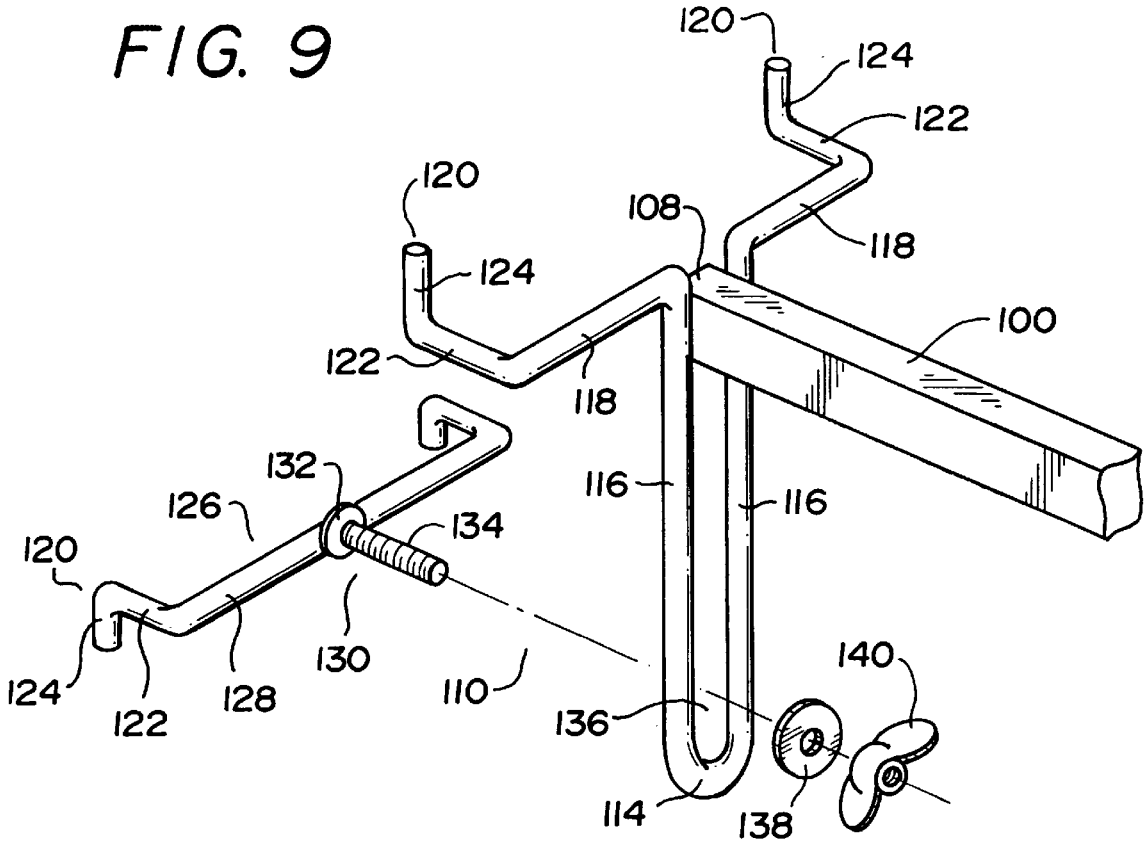
FIG. 9 is an exploded perspective view of the support member of FIG. 8.

Turning now to FIGS. 8 and 9, a third form of support member, indicated by reference numeral 90, is provided for use alternatively to support members 32 and 58. An L-shaped bracket 92, similar to L-shaped bracket having portions 18 and 20, may be affixed to the rear, planar surface portion of dimmer switch 10 as previously described. Alternatively, the L-shaped bracket 92 may be attached to a C-shaped bracket 94 which in turn is attached to the rear portion of dimmer switch 10 such as by a double-sided adhesive sheet 22 placed between the planar surface portion of dimmer switch 10 and an inner surface 96 of C-shaped bracket 94. The use of C-shaped bracket 94 enhances the support of the merchandise item 10 by providing a wider and longer connection surface and by providing legs 98 which support a top and bottom surface of dimmer switch 10.

Support member 90 comprises a peg bar 100 having a proximal end 102 and a distal end 108. A mounting device 110, as shown in FIGS. 8 and 9, is attached, preferably permanently, to the distal end 108 of the peg bar 100. The mounting device 110 may comprise a U-shaped member 112 having a bottom curve 114 and two substantially parallel legs 116. The mounting device 110 may further comprise two arms 118, each arm having an end extending substantially perpendicularly from an end of a leg 116. Attached to an opposite end of each arm 118 is a hook 120. Each hook 120 comprises a first portion 122 extending substantially perpendicularly to, but within the same plane as, each arm 118. Each hook 120 further comprises a second portion 124 extending substantially perpendicularly to first portion 122 and extending upwardly above the plane shared by first portion 122 and arm 118, such that second portion 124 extends above the remainder of the mounting device 110 and substantially parallel to the legs 116. Preferably the hooks 120 are not formed by exactly perpendicular portions but instead are slightly angled, i.e. portions 122 and 124 preferably form an angle slightly less than 90° to provide a hook-like grasp when inserted into a hole in a pegboard.

The support member 90 preferably further comprises a stabilizing bar 126 having an arm 128 having two ends. Each end of the arm 128 is provided with a hook 120 having a first portion 122 and a second portion 124 as previously described. The length of the arm 128 from a first hook 120 to a second hook 120 is preferably substantially the same as the combined lengths of the arms 118 and the width of the peg bar 100, but may be shorter or longer as desired. A screw 130 is attached to a central location along the arm 128, such that a screw head 132 of the screw 130 is attached to the arm 128 with the screw threads 134 extending substantially perpendicularly to the arm 128 and substantially within the same plane as the arm 128 and the first portion 122 of the hooks 120.

Figure 10:
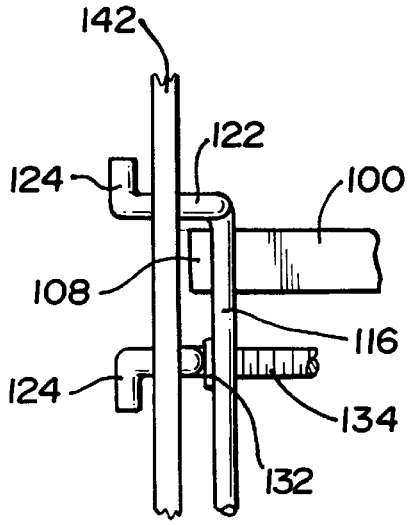
FIG. 10 is a side plan view of the substantially assembled support member of FIG. 9.

In use, as shown in FIG. 10, the mounting device 110 is inserted into a peg board 142 having at least four preformed openings. Typically, a peg board is provided with rows and columns of preformed openings with adjacent openings spaced approximately 3 inches apart. The hooks 120 of the mounting device 110 are inserted into two of the holes in the pegboard such that the first portion 122 of the hooks 120 pass through the pegboard 142 and the second portion 124 of the hooks 120 lie in parallel and potentially abutting relation to pegboard 142. Although the mounting device 110 is shown as being mounted with the legs 116 in a vertical position relative to a vertically mounted peg board 142, it should be understood that the mounting device 110 could also be mounted on the peg board 142 such that the legs 116 lie horizontally with respect to the pegboard 142 in either direction or mounted such that the bottom curve 114 is vertically above the legs 116 relative to the vertically mounted peg board 142. The changeable mounting positions lend versatility to the display device.

A merchandise item may be reasonably secured to a peg board 142 by using mounting device 110 alone; however, with just the mounting device 110 in place, the peg bar 100 may still pivot in one direction (the direction opposite the U-shaped member 112), thus a merchandise item retained thereon is at risk of being dislocated if hit, for example, by someone lifting up a box from a shelf below. In a preferred embodiment, therefore, stabilizing bar 126 is hooked onto the peg board 142 "below" the mounting device 110 (understanding that the relative positions would change if the mounting device 110 was mounted in an alternative position) as shown in FIG. 10. The U-shaped member 112 may be pivoted away from the peg board 142 such that hooks 120 of mounting device 110 pivot downwardly to allow the stabilizing bar 126 to be inserted into the peg board 142. The stabilizing bar may be positioned with any pair of holes on the peg board so long as the screw threads 134 of the screw 130 fits within the slot 136 between the legs 116 of the U-shaped member 112. The U-shaped member 112, and thus the mounting device 110, is then secured to the stabilizing bar by screwing a nut, such as wing nut 140, onto screw threads 134. Optionally, a washer 138 may also be used to limit scratching. By attaching the stabilizing bar 126 to the mounting device 110 as shown in FIG. 1, peg bar 100 is substantially immovable with respect to pegboard 142.

Figure 12:
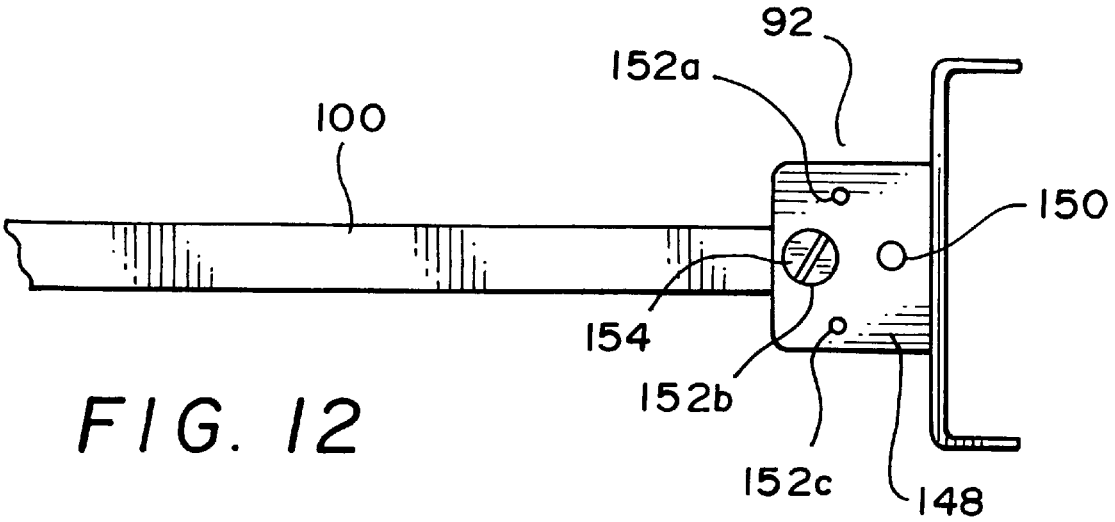
FIG. 12 is a side plan view of the merchandise item supporting bracket of FIG. 8; and, FIG. 13 is a side plan view of an alternate embodiment of a merchandise item supporting bracket.

An L-shaped bracket having portions 18 and 20 as previously described could be used at the proximal end 102 of the peg bar 100. Preferably, however, bracket 92 as shown in FIGS. 8 and 12 is used. Bracket 92 comprises a first planar portion 146 attached to either C-shaped bracket 96 as shown or directly to a rear planar surface of a merchandise item. If C-shaped bracket 96 is used in combination with L-shaped bracket 92, then L-shaped bracket 92 is preferably welded or otherwise securely attached to C-shaped bracket 96. Bracket 92 further comprises a second planar portion 148 extending substantially perpendicularly from first planar portion 146. The second planar portion 148 is preferably provided with at least four openings. A first opening, pivoting opening 150, is provided closest to the juncture between first and second planar portions 146 and 148. A plurality of second openings, 152*a*, 152*b* (obscured by wing nut 158 in FIG. 8 and by screw 154 in FIG. 12), and 152*c* are also provided in second planar portion 148. The center-to-center distance from pivoting opening 150 to each of openings 152*a*, 152*b*, and 152*c* is substantially equal.

Figure 11:
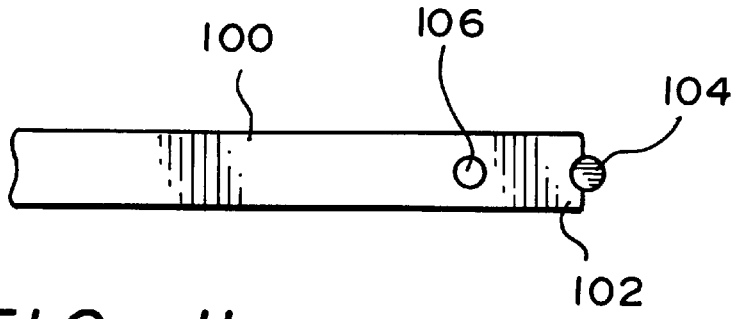
FIG. 11 is a side plan view of the proximal end of a peg bar as used in FIG. 8.

The proximal end 102 of the peg bar 100 is preferably provided with a pivot pin 104 as shown in FIG. 11. An opening 106 is preferably provided distally of the pivot pin 104 on the peg bar 100 at a distance equal to the center-to-center distance from the pivoting opening 150 to one of the second openings 152*a*–152*c*. In use, the pivot pin 104 is inserted into the pivoting opening 150. An angular orientation of the merchandise item with respect to the support member 90 is chosen. As previously discussed, the orientations selected is that which places the item most nearly in the line of sight of a shopper standing in front of the display. For example, if support member 90 is mounted at a position significantly below eye level, opening 152*c* is aligned with opening 106 and screw 154 is inserted through the aligned openings to place item 10 with its front face tilted upwardly. If support member 90 is mounted at or near average eye level, central opening 152*b* may be aligned with opening 106 and if support member 90 is mounted above eye level then opening 152*a* may be aligned with opening 106 for tilting the front face of an item 10 downwardly. A nut, such as wing nut 158 may be used to secure the screw 154 to the second portion 148 of the bracket 92 and to the peg bar 100. In all three orientations, the pivot pin 104 need not be moved out of pivoting opening 150. This embodiment requires less parts, and thus less assembly, than the bracket with first and second portions 18 and 20. Although only three orientations are discussed, additional second openings may be provided to allow for different angular orientations of the item being displayed with respect to the peg bar 100.

Figure 13:
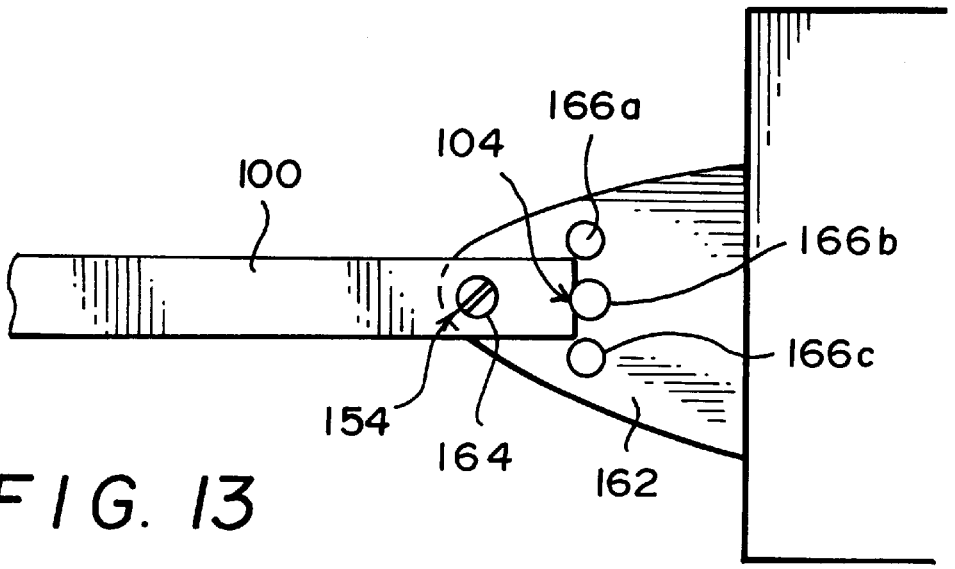

An alternate embodiment of the L-shaped brackets previously described is shown in FIG. 13. Bracket 162 is similar to that shown with respect to the first support member except that it is used with the peg bar 100 shown in FIG. 11. That is, pin 104 of peg bar 100 may be inserted into one of openings 166*a*, 166*b*, or 166*c* to provide a preferred angular orientation to the merchandise item being displayed. The proximal end 102 pivots about opening 106 which is aligned with opening 154. The peg bar 100 is secured to bracket 162 by screw 164 inserted into openings 106 and 154. Therefore, when an angular adjustment is to be made, the screw 164 need only be loosened (rather than completely disassembled) from bracket 162 to provide enough clearance to move pin 104 out of one of the openings 166*a*–166*c* and into a different one of the openings 166*a*–166*c*. This embodiment thus may prevent lost pieces.

From the foregoing, it will be appreciated that the present invention provides a unique and commercially effective means of displaying merchandise items in a retail setting. An actual item or product corresponding to that which the customer would normally purchase in a closed package, is supported in a conspicuous position and orientation for visual inspection and, where appropriate, for manual manipulation by the customer. Support members are disclosed in three embodiments, for alternate use by removable attachment to structure, e.g., a pegboard or shelf-front track member, normally found in retail establishments. Brackets for securing items to the support members are also disclosed in three embodiments. Although specific combinations of brackets and support members have been disclosed, it should be understood that any of the brackets could be used with any of the support members. Thus, the above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. Apparatus for displaying an item on a peg board comprising:

a) a peg bar having a distal end adapted to be adjacent a peg board and a proximal end for supporting an item;

b) a mounting device attached to the distal end of the peg bar, the mounting device having two hooks, two mounting arms, and a U-shaped member, each mounting arm attaching one of the two hooks to the U-shaped member, the hooks adapted to be inserted into holes of a peg board, the U-shaped member forming a slot; and, c) a stabilizing bar adapted to be removably attached to the mounting device, the stabilizing bar having two hooks adapted to be inserted into holes of a peg board.

2. The apparatus of claim 1 wherein the stabilizing bar comprises a stabilizing arm with a hook at each end of the stabilizing arm.

3. The apparatus of claim 2 wherein a screw having a threaded stem is attached to a central location of the stabilizing arm, the threaded stem of the screw adapted to pass through the slot in the U-shaped member.

4. The apparatus of claim 3 further comprising a nut for passing over the threaded stem of the screw and securing the stabilizing bar to the mounting device.

5. The apparatus of claim 3 wherein the threaded stem of the screw may pass through any location within the slot of the mounting device.

6. The apparatus of claim 1 wherein the hooks are integrally formed with the mounting device and the stabilizing bar.

7. The apparatus of claim 1 wherein the peg bar, mounting device, and stabilizing bar are made of metal.

8. The apparatus of claim 1 further comprising an L-shaped bracket comprising a first portion and a second portion, the second portion of the L-shaped bracket being removably attachable to the proximal end of the peg bar.

9. The apparatus of claim 8 wherein the second portion of the L-shaped bracket has a plurality of openings, and wherein the proximal end of the peg bar comprises a pin and a hole, the pin adapted to be inserted in one of the plurality of openings and the hole of the peg bar adapted to be aligned with another one of the plurality of openings.

10. The apparatus of claim 9 further comprising a screw which passes through the hole of the peg bar and one of the plurality of openings in the L-shaped bracket.

11. The apparatus of claim 8 further comprising a C-shaped bracket attached to the first portion of the L-shaped bracket.

12. A method of securing an item to a pegboard comprising the steps of:

a) securing an item to a bracket;

b) attaching a proximal end of a peg bar to the bracket;

c) inserting two hooks of a mounting device connected to a distal end of the peg bar into two holes in the pegboard;

d) lifting a U-shaped member of the mounting device at an angle relative to the peg board;

e) inserting two hooks of a stabilizing bar into two holes in the pegboard;

f) placing a slot in the U-shaped member of the mounting device over a threaded portion of a screw attached to a central location on the stabilizing bar; and, g) placing a nut over the threaded portion of the screw to secure the mounting device to the stabilizing bar.

13. The method according to claim 12 wherein the step of securing an item to a bracket comprises the steps of securing a C-shaped bracket to the item and attaching the C-shaped bracket to an L-shaped bracket which is attached to the proximal end of the peg bar.

14. The method according to claim 12 further comprising the step of selecting an angular orientation of the item with respect to the peg bar, and wherein the step of attaching the proximal end of the peg bar to the bracket comprises securing the peg bar to one of a plurality of holes in the bracket.

15. A peg bar support system for securing a peg bar to a peg board, the peg bar support system comprising:

a) a mounting device having two hooks and a generally U-shaped member forming a slot; and, b) a stabilizing bar removably attachable to the mounting device, the stabilizing bar having two hooks, wherein a screw extending substantially perpendicularly from the stabilizing bar is adapted to pass through the slot.

16. The peg bar support system of claim 15 wherein the mounting device comprises two mounting arms connecting the two hooks of the mounting device to the U-shaped member.

17. The peg bar support system of claim 16 wherein each hook comprises a first portion and a second portion extending substantially perpendicularly from the first portion.

18. The peg bar support system of claim 17 wherein the first portion of the hooks of the mounting device extend substantially perpendicularly from the mounting arms.

19. Apparatus for displaying an item on a peg board comprising:

a) a peg bar having a distal end adapted to be adjacent a peg board and a proximal end for supporting an item;

b) a mounting device attached to the distal end of the peg bar, the mounting device having two hooks adapted to be inserted into holes of a peg board; and, c) a stabilizing bar adapted to be removably attached to the mounting device, the stabilizing bar having a stabilizing arm with a hook at each end of the stabilizing arm, each hook adapted to be inserted into a hole of a peg board, wherein a screw having a threaded stem is attached to a central location of the stabilizing arm, the threaded stem of the screw adapted to pass through a slot in the mounting device.

20. The apparatus of claim 19 wherein the mounting device comprises tow mounting arms and a U-shaped member, each mounting arm attaching a hook of the mounting device to the U-shaped member, the U-shaped member forming the slot in the mounting device.

21. Apparatus for displaying an item on a peg board comprising:

a) a peg bar having a distal end adapted to be adjacent a peg board and a proximal end for supporting an item;

b) a mounting device attached to the distal end of the peg bar, the mounting device having two hooks adapted to be inserted into holes of a peg board;

c) a stabilizing bar adapted to be removably attached to the mounting device, the stabilizing bar having two hooks adapted to be inserted into holes of a peg board; and, d) an L-shaped bracket comprising a first portion and a second portion, the second portion of the L-shaped bracket being removably attachable to the proximal end of the peg bar.

22. The apparatus of claim 21 wherein the mounting device comprises two mounting arms and a U-shaped member, each mounting arm attaching a hook of the mounting device to the U-shaped member, the U-shaped member forming a slot.

23. The apparatus of claim 21 wherein the second portion of the L-shaped bracket has a plurality of openings, and wherein the proximal end of the peg bar comprises a pin and a hole, the pin adapted to be inserted in one of the plurality of openings and the hole of the peg bar adapted to be aligned with another one of the plurality of openings.

24. The apparatus of claim 23 further comprising a screw which passes through the hole of the peg bar and one of the plurality of openings in the L-shaped bracket.

25. The apparatus of claim 21 further comprising a C-shaped bracket attached to the first portion of the L-shaped bracket.

26. The apparatus of claim 21 wherein the stabilizing bar comprises a stabilizing arm with a hook at each end of the stabilizing arm.

27. The apparatus of claim 26 wherein a screw having a threaded stem is attached to a central location of the stabilizing arm, the threaded stem of the screw adapted to pass through a slot in the mounting device.

* * * * *